US007343704B1

(12) United States Patent
Wilson

(10) Patent No.: US 7,343,704 B1
(45) Date of Patent: Mar. 18, 2008

(54) LIGHTED SAFETY AND WARNING SIGNS

(76) Inventor: P. DeLois Wilson, 418 Ainsworth Cir., Ypsilanti, MI (US) 48197

( * ) Notice: Subject to any disclaimer, the term of this patent is extended or adjusted under 35 U.S.C. 154(b) by 5 days.

(21) Appl. No.: 11/333,762

(22) Filed: Jan. 17, 2006

(51) Int. Cl.
*G09F 3/18* (2006.01)

(52) U.S. Cl. ..... 40/547; 40/586

(58) Field of Classification Search ..... 40/586, 40/547, 546
See application file for complete search history.

(56) References Cited

U.S. PATENT DOCUMENTS 4,559,583 A * 12/1985 Ku ..... 362/565
4,919,578 A * 4/1990 Zeigler et al. ..... 411/113
4,975,809 A * 12/1990 Ku ..... 362/605
5,084,993 A * 2/1992 Dahlheimer ..... 40/547
6,266,903 B1 * 7/2001 Collins ..... 40/586

FOREIGN PATENT DOCUMENTS

GB 02321485 A * 7/1998
GB 02359654 A * 8/2001

* cited by examiner

*Primary Examiner*—Cassandra Davis
(74) *Attorney, Agent, or Firm*—Barbara M. Burns

(57) ABSTRACT

Illuminated warning signs of familiar shapes employ back lighting through letters of smoked translucent plastic or glass. The back lighting is produced by incandescent lights or light emitting diodes located behind the letters. Thus, for example, in daylight a stop sign will appear to have black or white letters in contrast to the red background of the stop sign, but at night the letters will glow. Since warning signs provide shape to indicate the nature of the warning, the perimeter of the sign is likewise caused to glow brightly by providing one or a plurality of light pipes illuminated by lamps or a plurality of light emitting diodes. Thus, the combination of the word and the perimeter glowing brightly make clear the nature of the warning despite the sign being otherwise obscured.

2 Claims, 1 Drawing Sheet

LIGHTED SAFETY AND WARNING SIGNS

This application claims the benefit of provisional patent application No. 60/327,696, filed Oct. 9, 2001, and patent application Ser. No. 10/268,026, filed Oct. 9, 2002.

BACKGROUND OF THE INVENTION

The invention pertains to safety and warning signs, such as stop signs, and, in particular, to hand-held signs, such as stop and slow signs used at road construction sites and by crossing guards at cross walks.

Such signs are commonly in use in daylight hours when visibility is not a significant problem. When daylight visibility does present a problem, the problem arises from heavy rain, heavy fog, snow or heavy blowing dust and dirt, all being conditions that cause outdoor construction activities to cease because of construction site hazards caused by visibility or wetness. Thus, there has not been a strong demand for hand-held signs that can be better seen through the above noted visibility problems. Also, with the advent of night highway construction and repair, despite the bright lights used at the construction sites, clearly visible hand-held warning signs are needed to improve safety for vehicle drivers and workers holding the signs.

SUMMARY OF THE INVENTION

The new warning signs comprise signs of the same familiar shapes and colors in daylight appearance, such as the octagon shaped "stop" sign with white or black lettering. The lettering, however, is formed by backlit smoked translucent plastic or glass. The back lighting is produced by incandescent lights or light emitting diodes located behind the letters. Thus, in daylight, the sign will appear to have black or white letters in contrast to the red background of a stop sign. Most warning signs, such as a "slow" sign, have a yellow background with black lettering and, therefore, as a lighted sign require the black smoked plastic or glass. In general, the lettering or symbols in the sign must possess excellent contrast in daylight or at night and in inclement weather.

Since warning signs provide shape to indicate the nature of the warning—octagon for stop, triangle for slow, schoolhouse for school zone—the perimeter structure of the sign is likewise caused to glow brightly by providing one or a plurality of light pipes illuminated by lamps or a plurality of light emitting diodes. Thus, the combination of the word and substantially the entire perimeter glowing brightly with substantially even intensity make clear the nature of the warning despite the sign being otherwise obscured by darkness or inclement weather.

DESCRIPTION OF THE PREFERRED EMBODIMENTS

Figure 1:
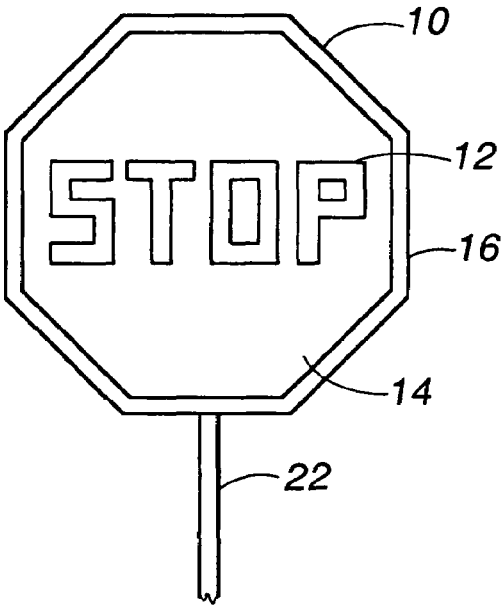
FIG. 1 is a front elevation of a stop sign.

Illustrated in FIG. 1 is stop sign 10 of octagonal shape having the letters 12 formed from smoked translucent glass or plastic and backlit. The red background 14 of the sign is formed of opaque red plastic or painted material. The octagonal perimeter 16 of the sign is formed from translucent milky white or clear tubes. Sources of light as explained below are provided to cause the sign lettering 12 and perimeter tubes 16 to glow brightly for visibility at a distance.

As an alternative, a translucent red plastic or glass may be substituted for the background and backlit by incandescent lamps or light emitting diodes (LED's). With the alternative version, the letters may be smoked and backlit or opaque black or white to contrast with the red.

Figure 2:
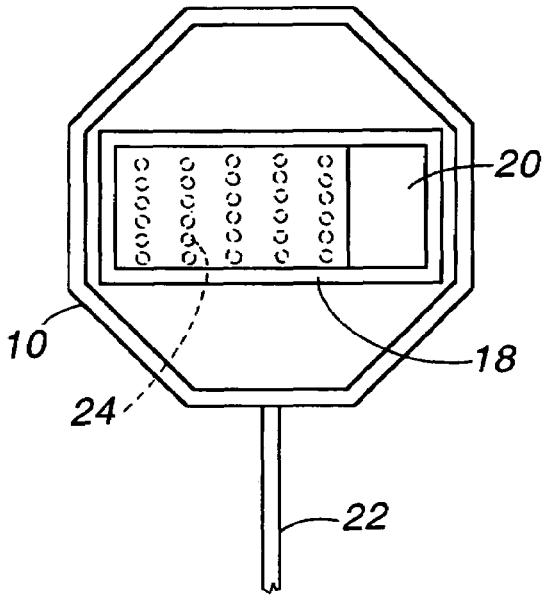
FIG. 2 is a back elevation of the sign showing the locations of the lighting elements.

In FIG. 2, a chamber 18 behind the letters 12 contains one or more lamps or a plurality of LED's to illuminate the letters. The chamber 18 may also enclose a battery 20 to power the lamps or LED's. As an alternative, the battery 20 might be located in the handle 22 for the sign. The battery 20 also provides power to light the peripheral tubes of the sign. Where the red background 14 is translucent, the chamber 18 may be sized to encompass substantially all of the back of the sign 10 with sufficient light sources inside to substantially evenly illuminate the background 14.

Figure 3:
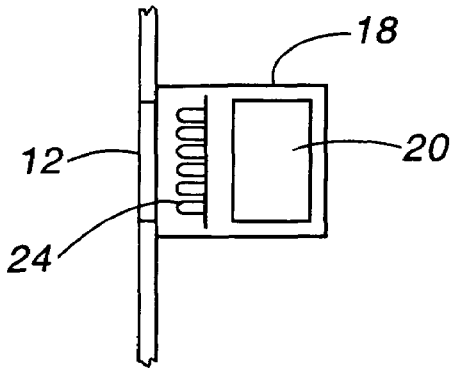
FIG. 3 is a cross-section of the center letter illumination source.

In FIG. 3, the chamber 18 encloses one or more lamps or LED's 24 so positioned as to evenly light each letter. Where batteries are used, LED's are preferable due to lower battery drain and less heat generation. However, as an alternative the lamps or LED's might be energized by large storage batteries resting on the ground nearby or a portable electric generator. The array of lamps or LED's will depend on the particular letters selected. Where the background is translucent, the sources of light may be more evenly distributed throughout the chamber 18.

Figure 4:
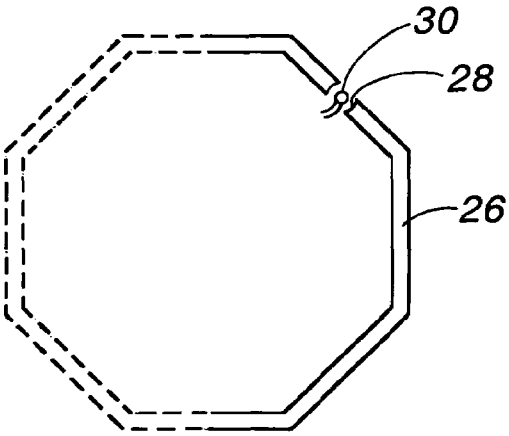
FIG. 4 is a partial cutaway of a light pipe peripheral illumination structure.

In FIG. 4, a translucent or clear light pipe 26 is bent to conform to the peripheral shape of the sign. At one or more locations 28 about the sign, a lamp or LED assembly 30 injects light into the light pipe 26 causing a glow of substantially even intensity in substantially the entire peripheral shape of the sign.

Figure 5:
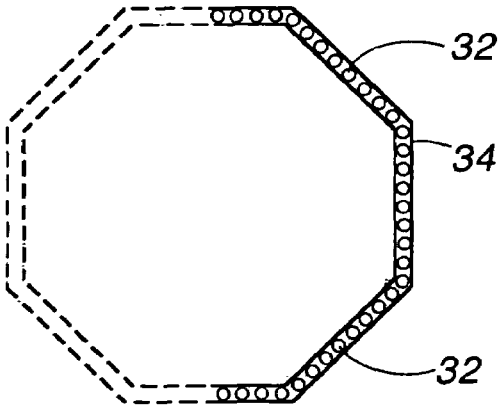
FIG. 5 is a partial cutaway of a light emitting diode peripheral illumination structure.

Alternatively, in FIG. 5 a plurality of LED's 32 may be arranged in a translucent or clear tube 34 also conforming to the peripheral shape of the sign. Although incandescent lamps or LED's have been illustrated above, a fluorescent or other light source might be employed.

The invention claimed is:

1. A safety and warning sign comprising one or more symbols in a background of contrasting color, means to illuminate the symbols, a peripheral light emitting structure, said structure adapted to glow with substantially even intensity about the sign periphery, means to illuminate the structure, wherein the peripheral light emitting structure comprises a peripheral light pipe about the entire periphery of the sign and the structure illumination means comprises at least one light emitting diode in the path of the light pipe whereby the light pipe is caused to glow evenly, and wherein said background of contrasting color is at least partially light transmissible and including a chamber behind at least a portion of the background, said symbol illumination means located within the chamber and positioned to illuminate at least a portion of the background.

2. A safety and warning sign comprising one or more symbols in a background of contrasting color, means to illuminate the symbols, a peripheral light emitting structure, said structure adapted to glow with substantially even intensity about the sign periphery, means to illuminate the structure, wherein the peripheral light emitting structure comprises a peripheral light pipe about the entire periphery of the sign and the structure illumination means comprises at least one incandescent lamp in the path of the light pipe whereby the light pipe is caused to glow evenly, and wherein said background of contrasting color is at least partially light transmissible and including a chamber behind at least a portion of the background, said symbol illumination means located within the chamber and positioned to illuminate at least a portion of the background.

* * * * *